US011608094B2

(12) United States Patent
Ring

(10) Patent No.: US 11,608,094 B2
(45) Date of Patent: Mar. 21, 2023

(54) ARTICULATED RAIL COUPLER

(71) Applicant: KACI TERMINALS SYSTEM, LTD.

(72) Inventor: Michael E. Ring, Lake Village, IN (US)

(73) Assignee: KACI TERMINALS SYSTEM, LTD., Greenville, OH (US)

( * ) Notice: Subject to any disclaimer, the term of this patent is extended or adjusted under 35 U.S.C. 154(b) by 824 days.

(21) Appl. No.: 16/461,768

(22) PCT Filed: Nov. 16, 2017

(86) PCT No.: PCT/US2017/061954
§ 371 (c)(1),
(2) Date: May 16, 2019

(87) PCT Pub. No.: WO2018/094004
PCT Pub. Date: May 24, 2018

(65) Prior Publication Data

US 2019/0359232 A1 Nov. 28, 2019

Related U.S. Application Data

(60) Provisional application No. 62/423,244, filed on Nov. 17, 2016.

(51) Int. Cl.

| | |
|---|---|
| ***B61G 5/02*** | (2006.01) |
| ***B61D 3/18*** | (2006.01) |
| ***B61F 5/16*** | (2006.01) |

(52) U.S. Cl.
CPC ..... *B61G 5/02* (2013.01); *B61D 3/184* (2013.01); *B61F 5/16* (2013.01)

(58) Field of Classification Search
CPC ..... B61G 5/00; B61G 5/02; B61D 3/10; B61D 3/16; B61D 3/184; B61D 3/185;
(Continued)

(56) References Cited

U.S. PATENT DOCUMENTS

| | | | | |
|---|---|---|---|---|
| 3,396,673 A * | 8/1968 | Livelsberger | ..... | B61G 5/02 384/423 |
| 4,336,758 A * | 6/1982 | Radwill | ..... | B61D 3/20 105/420 |
| 5,131,331 A * | 7/1992 | Lynch, Jr. | ..... | B61G 5/02 213/74 |

(Continued)

FOREIGN PATENT DOCUMENTS

| | | |
|---|---|---|
| BE | 728101 | 6/1969 |
| EP | 0208228 | 1/1987 |

(Continued)

*Primary Examiner* — Zachary L Kuhfuss
*Assistant Examiner* — Cheng Lin
(74) *Attorney, Agent, or Firm* — AP Patents; Alexander Pokot

(57) ABSTRACT

An articulated rail coupler comprises a base member, a female connecting member, a male connecting member, a bearing race, a first bearing seated within the bearing race and defining a vertical axis of rotation, and a second or a coupler bearing configured and sized to be received within a truck bogie bearing bowl. The male connecting member is allowed to rotate relative to the female connecting member about the vertical axis of rotation in a range of about ninety degrees, when the male connecting member and the female connecting member are coupled therebetween by the first bearing.

18 Claims, 13 Drawing Sheets

(58) Field of Classification Search
CPC ..... B61F 3/12; B61F 5/00; B61F 5/16; B61F 5/38; B61F 5/42; B61F 5/50
See application file for complete search history.

(56) References Cited

U.S. PATENT DOCUMENTS 5,172,819 A * 12/1992 Daugherety, Jr. ..... B61G 5/02 213/75 R
5,520,295 A * 5/1996 Wiebe ..... B61G 5/02 280/511
5,809,898 A * 9/1998 Kaufhold ..... B61G 5/02 384/510
5,901,649 A * 5/1999 Hathaway ..... B61B 1/005 104/29
6,167,813 B1 * 1/2001 Kaufhold ..... B61G 5/02 105/3
6,691,883 B1 * 2/2004 Daugherty, Jr. ..... B61G 5/02 384/202
7,467,724 B2 * 12/2008 Voong ..... B61G 5/02 105/3
7,798,345 B2 * 9/2010 Krome ..... B61G 5/02 213/69
7,832,575 B2 * 11/2010 Krome ..... B61G 5/02 213/75 R
8,033,748 B2 * 10/2011 Krome ..... B61F 3/12 403/135
8,590,718 B2 * 11/2013 Krome ..... B61G 5/02 213/62 R

FOREIGN PATENT DOCUMENTS

EP 2279925 2/2011
EP 2388173 11/2011
EP 2532562 12/2012

* cited by examiner

ARTICULATED RAIL COUPLER

BACKGROUND

1. Technical Field

The subject matter relates to couplers for railcars. It further relates to couplers allowing articulation of railcars so that lengths of two adjacent railcars being coupled therebetween are positioned at an angle of 90 degrees to each other.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In general, the most efficient point-to-point transportation of freight can combine the best features of the railroad system and the highway system. Highway vehicles can be preferred for reaching most individual addresses, because of the ubiquity of the highway system. However, for long distance transportation, where cost per ton-mile is very important, the railroad system can be the most efficient.

One method of exploiting the advantages of the two systems is to use highway vehicles to pick up freight at specific addresses, and then to load the highway vehicles onto railroad vehicles for long distance transportation. Subsequently, in the vicinity of the destination, the highway vehicles are off-loaded, and used to carry the freight to the final addresses.

Most commonly, the highway vehicles are tractor trailer combinations. After picking up freight at specific addresses, the tractor-trailer combinations are driven to terminals, where the trailers are uncoupled from the tractors and placed on rail vehicles. The trailers are then carried on the rail vehicles to terminals close to the intended destinations for the freight. The trailers are then removed from the rail vehicles, connected to tractors and are then pulled to their destinations.

One method of loading the trailers onto rail vehicles is to lift them by machinery such as cranes or forklifts. The required machinery for lifting the loaded trailers is very large and expensive, and the method cannot readily be used for trailers such as tankers without the addition of a large amount of structure to such trailers. This approach can considerably increase the ton-miles to be carried.

Another method employs a rotary loader attached to the dock. It is rotated so a portion of it is extended over the rail vehicle so trailers can be moved on and off of the rail vehicles.

Another approach is to use a moveable ramp, which can be moved along the edge of a dock adjacent the rail vehicles, and extend bridges to a position oblique to the rail vehicles and the edge of the dock so that trailers can be moved onto and off of the rail vehicles.

BRIEF DESCRIPTION OF THE DRAWINGS

The accompanying drawings are incorporated in and constitute part of the specification and illustrate various embodiments. In the drawings.

DETAILED DESCRIPTION OF EXEMPLARY EMBODIMENTS

Figure 1:
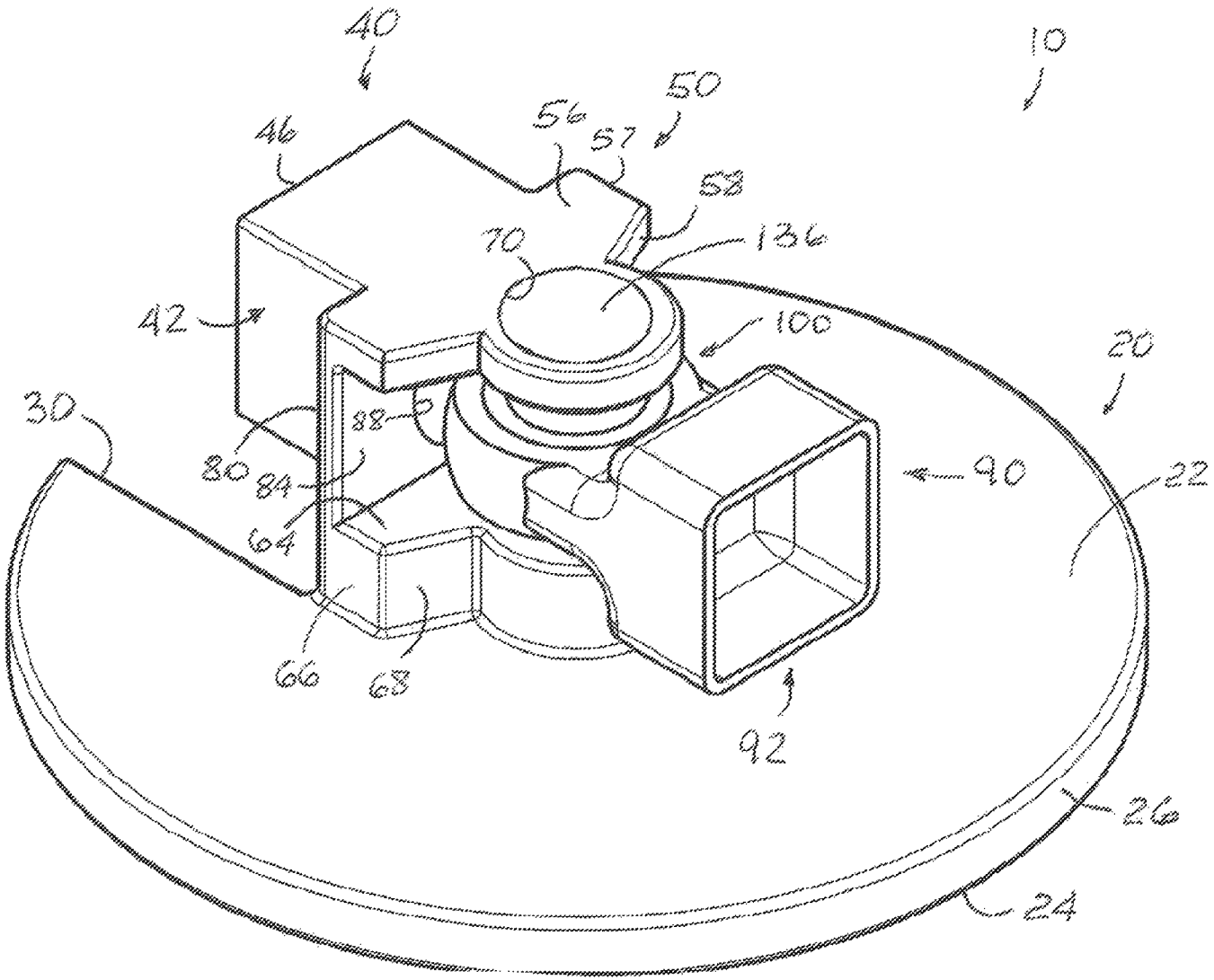
FIG. 1 illustrates a 3D view of an exemplary articulated rail coupler.
Figure 2:
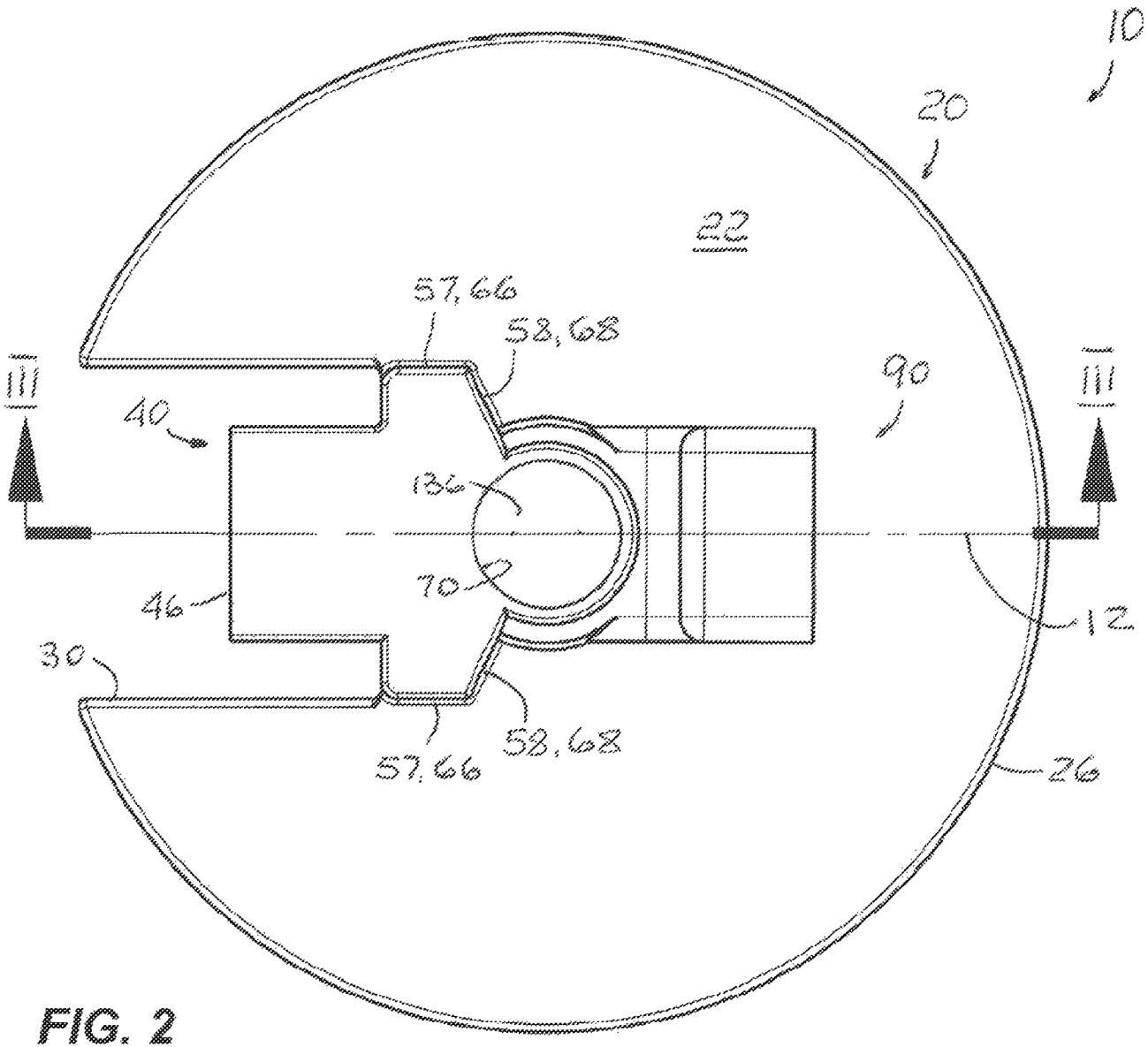
FIG. 2 illustrates a top view of the articulated rail coupler of FIG. 1.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. When used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

References in the specification to "an embodiment", "an example" and similar phrases mean that a particular feature, structure, or characteristic described in connection with the embodiment or variation, is included in at least an embodiment or variation of the invention. The phrase "in an embodiment", "in an example" or similar phrases, as used in various places in the specification, are not necessarily meant to refer to the same embodiment or the same variation.

For purposes of description herein, the directional and/or relationary terms such as "upper," "top," "lower," "bottom," "left," "right," "rear," "back," "front," "apex," "vertical," "horizontal," "lateral," "exterior," "interior," and derivatives thereof are relative to each other and are dependent on the specific orientation of an applicable element or article, and are used accordingly to aid in the description of the various embodiments and are not necessarily intended to be construed as limiting.

Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The term "or" when used in this specification and the appended claims is not meant to be exclusive; rather the term is inclusive, meaning either or both.

The term "couple" or "coupled" when used in this specification and appended claims refers to an indirect or direct physical connection between the identified elements, components, or objects. Moreover, where first and second devices are coupled, intervening devices including active devices may be located there between. Often the manner of the coupling will be related specifically to the manner in which the two coupled elements interact.

The term "directly coupled" or "coupled directly," when used in this specification and appended claims, refers to a physical connection between identified elements, components, or objects, in which no other element, component, or object resides between those identified as being directly coupled.

The term "operatively coupled," when used in this specification and appended claims, refers to a physical connection between identified elements, components, or objects, wherein operation of one of the identified elements, components, or objects, results in operation of another of the identified elements, components, or objects. For example, where the articulated rail coupler 10 is rigidly connected to opposite ends of a pair of adjacent railcars 200, the resulting coupling arrangement allows coupling of one railcar 200 to another railcar 200 or a locomotive (not shown) and decoupling such railcar 200 therefrom.

The terms "removable", "removably coupled", "removably disposed," "readily removable", "readily detachable", "detachably coupled", "separable," "separably coupled," "releaseably attached", "detachably attached" and similar terms, when used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

It will be understood that when an element is referred to as being "on" another element, it can be directly on the other element or intervening elements may present therebetween. In contrast, when an element is referred to as being "directly on" another element, there are no intervening elements present. As used herein the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer, or section from another element, component, region, layer or section. Thus, "a first element," "component," "region," "layer," or "section" when discussed below could be termed a second element, component, region, layer, or section without departing from the teachings herein.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated degrees or at other orientations) and the spatially relative descriptors used herein interpreted accordingly.

The term "semi-permanent" is meant herein that the opposite ends of a pair of adjacent railcars can be coupled and uncoupled but otherwise remain coupled during operation.

The term "substantially horizontally" when used herein when referring to elements or features of the articulated rail coupler should be understood to mean that such elements or features are positioned with respect to a vertical line extending there above at an angle of 90°, except for manufacturing tolerances. The angle can be in the range of from about 89° to about 91°, in the range of from about 88° to about 92°, in the range of from about 87° to about 93°, or in the range of from about 85° to about 95°. In other words, the term "substantially horizontally" should be also understood to mean that, if deviating from absolutely horizontal, the articulated rail coupler is operable to allow coupling/uncoupling of opposite ends of a pair of adjacent railcars therebetween or coupling/uncoupling of the railcar to/from a locomotive and allow loading, unloading and transport of objects over a rail network.

The term "generally horizontal(ly)" or "generally vertical(ly)" should be also understood to mean respectively horizontally or vertically disposed element or surface but the term does not exclude the possibility of orienting such feature or surface at a small angle relative to respectively absolute horizontal or vertical plane or line.

The terms and words used in the following description and claims are not limited to the bibliographical meanings, but, are merely used to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The particular embodiments of the present disclosure generally provide devices, and methods directed to articulated couplers for railcars.

In particular embodiments, an articulated rail coupler couples opposite ends of a pair of adjacent railcars in a semi-permanent manner.

In particular embodiments, an articulated rail coupler couples an end of the railcar to a locomotive.

In particular embodiments, a railcar comprises a pair of tapered ends.

Reference is now made, to FIGS. 1-5, wherein there is shown an exemplary articulated rail coupler, generally designated as 10. The articulated rail coupler 10 comprises a base member 20, a female connecting member 40, a male connecting member 90, a bearing race 120, a first bearing 130, and a second or a coupler bearing 140 configured and sized to be received within a truck bogie bearing bowl.

The base member 20 is being illustrated as a disk-shaped member, although other shapes are also contemplated herewithin. The base member comprises an upper surface 22 and a lower surface 24. The upper surface 22 is being disposed substantially horizontally during use of the articulated rail coupler 10. The lower surface 24 is being spaced apart from the upper surface 22 to define a thickness and a peripheral edge surface 26 of the base member 20. Although the surfaces 22 and 24 have been illustrated as planar surfaces, voids and/or abutments can be provided. In other words, the surface 22 and/or 24 does not have to be a planar surface. The base member 20 can be adapted with a void 30 through the thickness of the base member 20 and in an open communication with the peripheral edge surface 26. The void 30 when provided, is disposed in a non-load bearing portion of the base member 20. The void 30, when provided, reduces weight of the base member 20 and, respectively, of the articulated rail coupler 10. The base member 20 can be manufactured by a casting or a forging process, particularly when optional void 30 is provided or can be machined from a plate stock.

Figure 3:
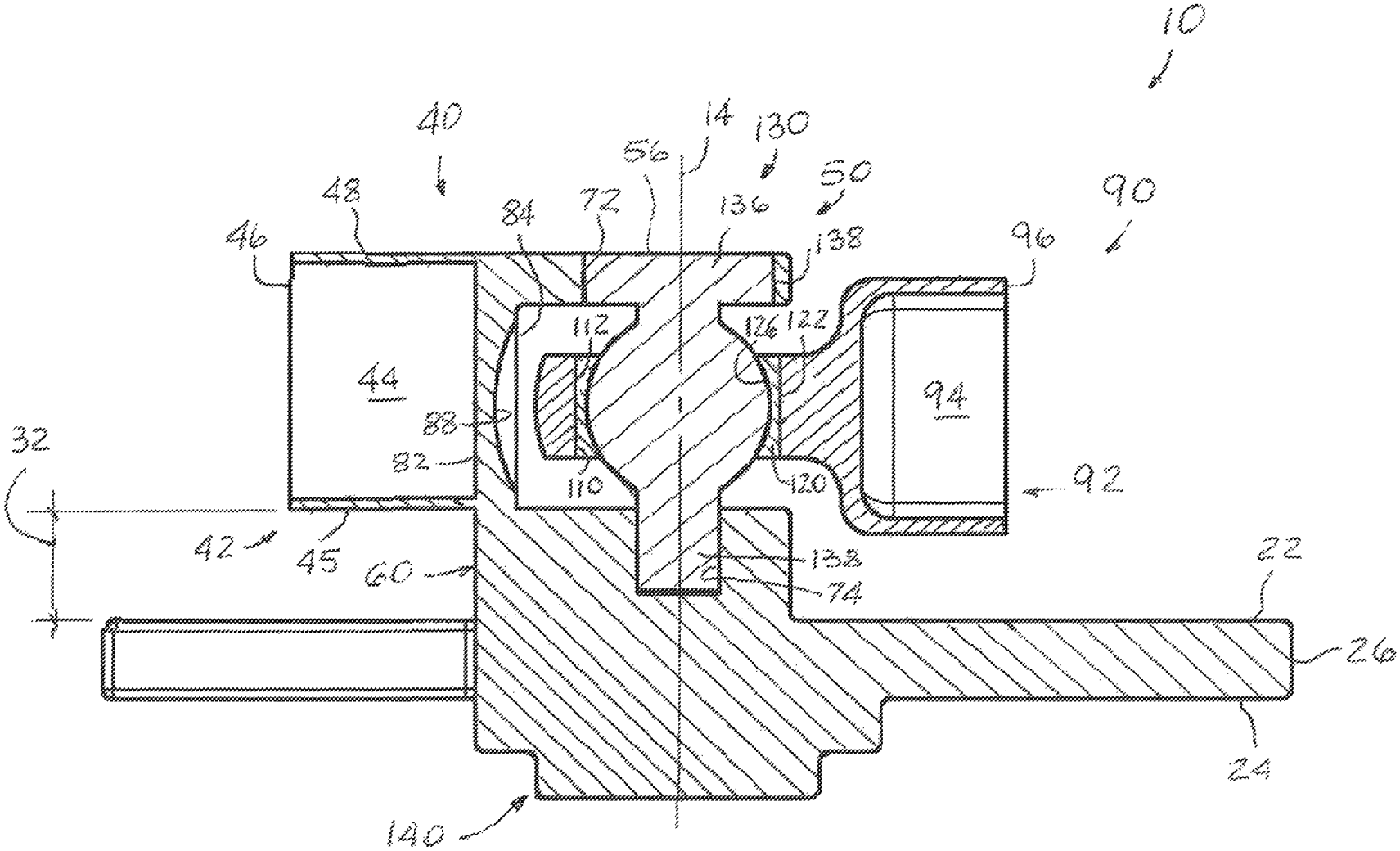
FIG. 3 illustrates a cross-sectional view of the articulated rail coupler, along lines III-III of FIG. 2.
Figure 4:
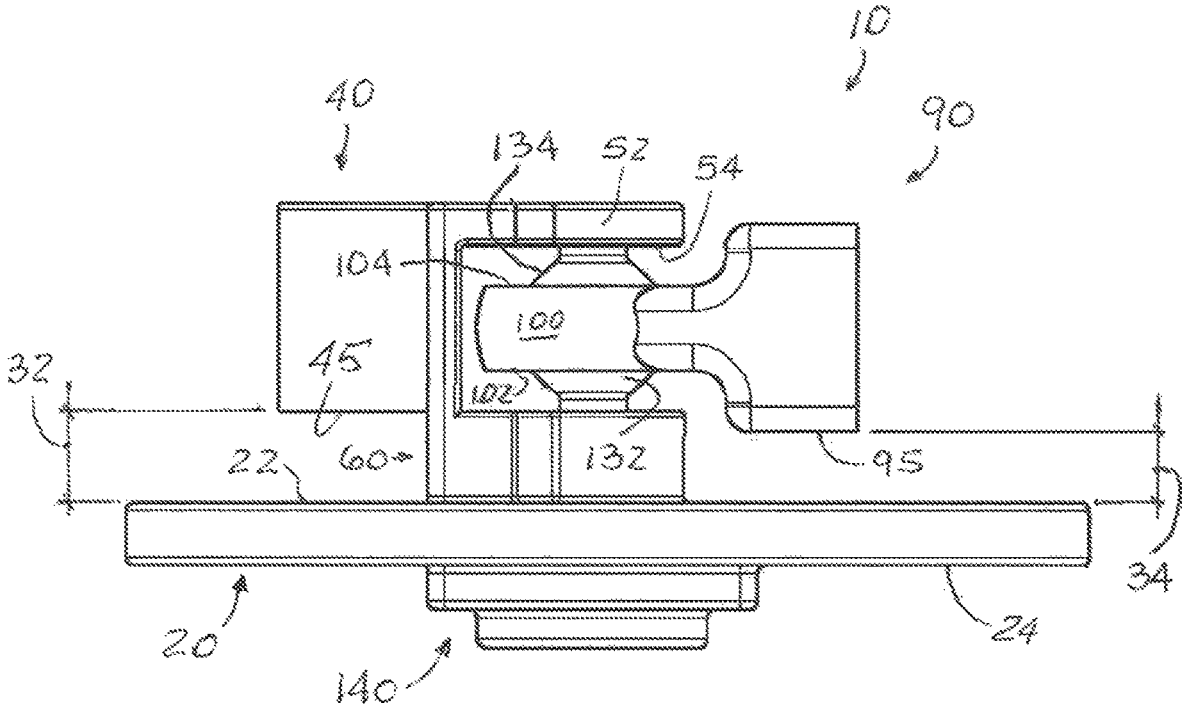
FIG. 4 illustrates a front view of the articulated rail coupler of FIG. 1; the rear view is identical.
Figure 5:
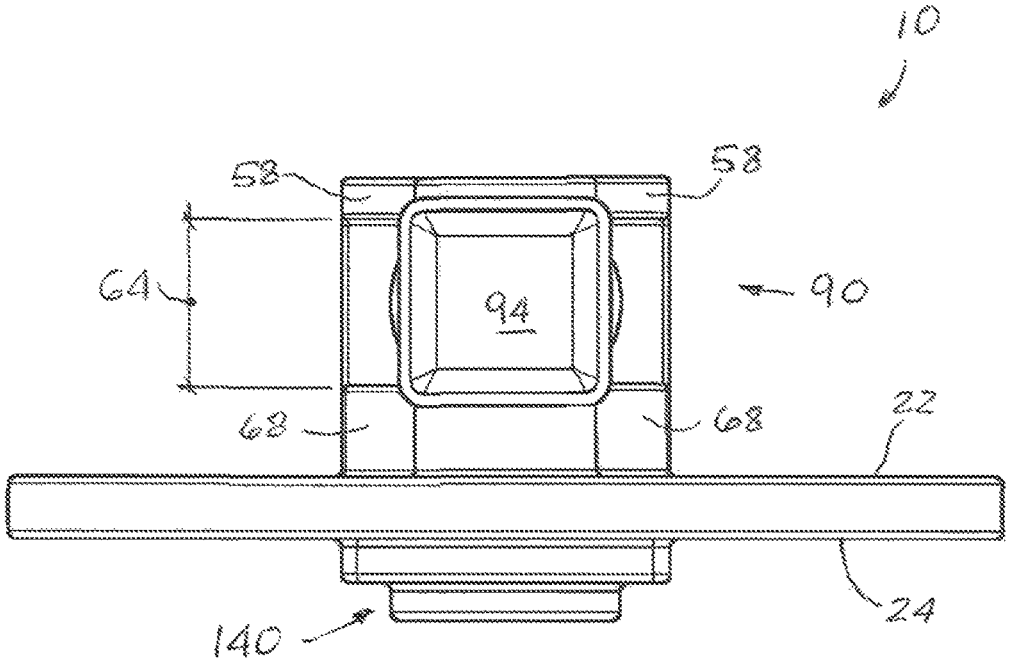
FIG. 5 illustrates one end view of the articulated rail coupler of FIG. 1.

The female, or first, connecting member 40 defines a first axis 12 of the articulated rail coupler 10. The first axis 12 is being disposed horizontally or substantially horizontally during operation of the articulated rail coupler 10 and is aligned after assembly with a longitudinal axis of the railcar. Or the first axis 12 can also be the longitudinal axis of the railcar. The female connecting member 40 comprises a first end 42 with a bottom surface 45 positioned at a first distance 32 from the upper surface 22. In other words, the first end 42 is positioned at a first distance 32 above the upper surface 22. When the void 30 is provided, the first end 42 is positioned over the void 30. The first end 42 can be sized and shaped to operatively couple to a center sill (not shown) of a railcar. Accordingly, the first end 42 comprises a generally rectangular or a generally square cross-section in a plane normal to the upper and lower surfaces, 22 and 24 respectively. The first end 42 can be solid throughout or can comprise an optional cavity 44. The cavity 44 can be in an open communication with a free peripheral edge 46 of the first end 42. When provided, the cavity 42 reduces weight of the female connecting member 40 and, respectively reduces the weight of the articulated rail coupler 10. When the cavity 44 is provided, the first end 42 essentially defines a box-shaped member. The first end 42 is aligned along the first axis 12 of the articulated rail coupler 10. During operation of the articulated rail coupler 10, the first end 42 is rigidly coupled, by a welding process, to an end of the railcar, for example the above mentioned center sill (not shown). The female connecting member 40 also comprises a second end 50. The second end 50 comprises a first wall 52 with an inner surface 54, an outer surface 56 and a pair of first edge surfaces 58. Each of the pair of first edge surfaces 58 is being disposed generally normal to the upper surface 22 and tapering inwardly from a respective side edge surface 57 of the first wall 52. The second end 50 also comprises a second wall 60 upstanding on the upper surface 22 of the base member 2. The second wall 60 comprising an inner surface 64 disposed generally parallel to and at a distance from the inner surface 54 of the first wall 52. The second wall 60 also comprises a pair of second edge surfaces 68, each of the pair of second edge surfaces 68 being disposed generally normal to the upper surface 22 and tapering inwardly from a respective side edge surface 66 of the second wall 60. Each of the pair of second edge surfaces 68 is being coplanar, in a vertical plane, with a respective one of the pair of first edge surfaces 58. An aperture 70 is formed through a thickness of the first wall 52 and has an inner surface 72. There is also a bore 74 formed in the second wall 60 in a vertical or substantially vertical alignment with the aperture 70. The aperture 70 and the bore 74 define a second axis 14 of the articulated rail coupler 10. The second axis 14 is being disposed vertically or substantially vertically during the operation of the articulated rail coupler 10 and normal to the first axis 12. The second axis 14 defines a vertical axis of rotation. A third wall 80 connects the first wall 52 and the second wall 60 therebetween. The third wall 80 has an outer surface 82 being in an abutting relationship with the first end 42 and comprising an inner surface 84. An optional cavity 88 can be disposed in the inner surface 84 of the third wall 80. An upper surface 48 of the first end 42 and the upper surface 56 of the second end 50 are essentially coplanar with each other and define a unitary upper surface of the female connecting member 40. The female connecting member 40 can be welded to the base member 20 at the second wall 60. As is best illustrated in FIG. 3, the female connecting member 40 can be integrated with the base member 20 and provided as a one-piece unitary member. This one-piece unitary member can be manufactured by a casting or a forging process.

The male, or second, connecting member 90 comprises a first end 92 with a bottom surface 95 positioned at a second distance 34 from the upper surface 22. In other words, the second end 92 is positioned at the second distance 34 from the upper surface 22. The second distance 34 can be the same as the first distance 32 or can be sized smaller or larger. The first end 42 is sized and shaped to operatively couple to a center sill (not shown) of a railcar. Accordingly, first end 92 comprises a generally rectangular or a generally square cross-section in the plane normal to the upper and lower surfaces, 22 and 24 respectively. The first end 92 can be solid throughout or can comprise an optional cavity 94. The optional cavity 94 can be in an open communication with a free peripheral edge 96 of the first end 92. When provided, the cavity 94 reduces weight of the male connecting member 90 and, respectively reduces the weight of the articulated rail coupler 10. When the cavity 94 is provided, the first end 92 essentially defines a box-shaped member. It should be noted that the optional cavity 94 can be provided together with or separately from the optional cavity 44. During operation of the articulated rail coupler 10, the first end 92 is rigidly coupled to an end of the railcar. The male connecting member 90 also comprises a second end 100. The second end 100 comprises a first surface 102, a second surface 104 being spaced apart from the first surface 102, a thickness of the second end 100 of the male connecting member 90 being defined by a distance between the first surface 102 and the second surface 104. The thickness of the second end 100 of the male connecting member 90 is being smaller than the distance between the inner surface 54 of the first wall 50 and the inner surface 64 of the second wall 60 of the second end 50 of the female connecting member 40. An aperture 110 is provided through the thickness of the second end 100 of the male connecting member 90. The aperture 110 of the male connecting member 90 has an inner surface 112 and is being axially aligned along the second axis 14 with the aperture 70 through the first wall 52 of the second end 50 of the female connecting member 40 and with the bore 74. As it can be further seen from FIGS. 1-5, the first end 92 of the male connecting member 90 is being generally aligned with the first end 42 of the female connecting member 40 along the first axis 12. The male connecting member 90 can be manufactured by a casting or a forging process.

The bearing race 120 is disposed in the aperture 110 of the second end 100 of the male connecting member 90. The bearing race 120 comprises and outer surface 122 sized and shaped to contact the inner surface 112 of the aperture 110 through the thickness of the second end 100 of the male connecting member 90 so as to prevent a movement of the bearing race 120 relative to the aperture 110 through the thickness of the second end 100 of the male connecting member 90. The bearing race 120 further comprises an inner surface 126 with a partially spherical shape.

The first bearing 130 comprises a main portion 132 comprising a partially spherical exterior surface 134 being sized to be received within the inner surface 126 of the bearing race 120. The main portion 132 is being further sized to pass through the aperture 70 in the second end 60 of the female connecting member 40. The first bearing 130 also comprises a first end 136 extending from the main portion 132. The first end 136 is being sized to be seated within the aperture 70 in the second end 50 of the female connecting member 40. The first bearing 130 additionally comprises a second end 138 extending from the main portion 132 axially opposite to the first end 136 of the first bearing 130 along the second axis 14. The second end 138 is being sized to be seated within the bore 74 in the second end 50 of the female connecting member 40. The first end 136 is being illustrated as being larger than the second end 138. However, the first end 136 and the second end 138 can be sized generally identically, by using a washer-shaped member (not shown) to compensate for a larger size of the aperture 70. Although, the first aperture 70 and the first end 136 are being illustrated as rounds, the first and second ends 136, 138 respectively, can be adapted with different cross-sectional shapes, to complement shape(s) of the first aperture 70 and/or bore 74. In either configuration, the bearing 130 is prevented from a rotation about the second axis 14. In other words, the first end 136 is prevented from a rotation within the aperture 70 and/or the second end 138 is prevented from a rotation within the bore 74. When the aperture 70 and the first end 136 are provided with round cross-section, the first end 136 can be seated within the aperture 70 by way of an interference or frictional fit between the outer peripheral surface 137 of the first end 136 and the inner surface of the aperture 70. In other words, in this example, the outer peripheral surface 137 is being sized slightly larger than the inner surface 72. If the aperture 70 is provided with other than the round shape, for example such as a square shape, the complimentary outer peripheral surface 137 can be sized for the above described frictional or interference fit, can be sized slightly smaller than the inner surface 72 to provide a slip fit between the aperture 70 and the first end 136 and even be sized to allow a light play or a movement of the first end 136 within the aperture 70, but without affecting performance of the articulated rail coupler 10. Similar considerations apply to the bore 74 and the second end 138. In any of the above examples, the bearing race 120 and/or first bearing 130 can be configured as a wear component to be removed and replaced during use of the articulated rail coupler 10 so as to extend operating life of the articulated rail coupler 10 by minimizing the retrofit costs. In an example, the bearing race 120 can comprise a material that reduces a friction between the main portion 132 of the first bearing 130 and the aperture 110 in the male connecting member 90. Such material can be a bronze, a polymer, for example such as nylon, teflon or any other material suitable for use in a rail environment. It would be understood, that the cost to remove and replace the bearing race 120 and/or first bearing 130 is far less than a cost to remove and replace either the female coupling member 40 or the male coupling member 90. For the reasons to be explained later in this document, during operation of the articulated rail coupler 10, the second end 100 of the male connecting member 90 moves in an articulated manner about the main portion 132 of the first bearing 130 so that the male connecting member 90 moves in the articulated manner about the female connecting member 40. The male connecting member 90 also pivots or rotates in the horizontal plane about the second axis 14, during the operation of the articulated rail coupler 10, in a range of about ninety degree. The first and second edge surfaces, 58 and 68 respectively, of the second end 50 of the female connecting member 50 can be positioned to limit pivoting or rotation of the male connecting member 90 about the second axis 14. In other words, the first and second edge surfaces, 58 and 68 respectively, can be configured to operate as stops.

The second bearing 140 upstands on the lower surface 24 of the disk-shaped base member 20. The second bearing 140 is being sized and shaped to be received within a truck bogie bearing bowl 292. The second bearing 140 can be welded to the bottom surface 24 of the base member 20. As is best illustrated in FIG. 3, the second bearing 140 can be integrated with the base member 20 and provided as a one-piece unitary member. This one-piece unitary member can be manufactured by a casting or a forging process. As is further illustrated in FIG. 3, the second bearing 140, the female connecting member 40 and the base member 20 are provided as a one-piece unitary member and can be also referred to as a female connecting member.

Thus, in an embodiment, the articulated rail coupler 10 comprises a base member 20; a female connecting member 40 comprising a first end 42 positioned at a distance from an upper surface 22 of the base member 20, and a U-shaped second end 50 upstanding on the upper surface 22 of the base member 20 and being axially aligned with the first end 42 along a first axis 12 disposed substantially horizontally during operation of the articulated rail coupler 10; a first bearing 130 being secured in the U-shaped second end 50 and defining a second axis 14 being normal to the first axis 12 and being disposed generally vertical during the operation of the articulated coupler 10; a male connecting member 90 comprising a first end 92 and a second end 100; a bearing race 120 disposed within an aperture 110 in the second end 100, the first bearing 130 operatively meshing with the bearing race 120; the male connecting member 90 being configured to articulate about a portion of the first bearing 130 and within the U-shaped second end 50 and rotate about the second axis 14; and a second bearing 140 upstanding on a lower surface 24 of the base member 20, the second bearing 140 being sized and shaped to be received within a truck bogie bearing bowl. A feature of this embodiment is that each or both of the first end 42 and first end 92 can comprise a box-shaped structure.

It is also contemplated herewithin that the inner surface 112 of the aperture 110 can be provided as a partially spherical surface to complement the partially spherical surface 134 of the main portion 130. In other words, the articulated rail coupler 10 can be provided without the bearing race 120. In this embodiment, the partially spherical surface 134 can be adapted with an optional liner or a coating (not shown) that reduces friction during pivoting or rotation of the male connecting member 40. Such liner or coating (not shown) can be a polymer, for example such as nylon, teflon or any other material suitable for use in the rail environment.

Thus, in an embodiment, the articulated rail coupler 10 comprises a base member 20; a female connecting member 40 comprising a first end 42 positioned at a distance from an upper surface 22 of the base member 20, and a U-shaped second end 50 upstanding on the upper surface 22 of the base member 20 and being axially aligned with the first end 42 along a first axis 12 disposed generally horizontally during operation of the articulated rail coupler 10; a first bearing 130 being secured in the U-shaped second end 50 and defining a second axis 14 being normal to the first axis 12 and being disposed generally vertical during the operation of the articulated coupler 10; a male connecting member 90 comprising a first end 92 and a second end 100 configured to articulate about a portion of the first bearing 130 and within the U-shaped second end 50 and rotate about the second axis 14; and a second bearing 140 upstanding on a lower surface 24 of the base member 20, the second bearing 140 being sized and shaped to be received within a truck bogie bearing bowl 292. A feature of this embodiment is that each or both of the first end 42 and first end 92 can comprise a box-shaped structure.

Figure 6:
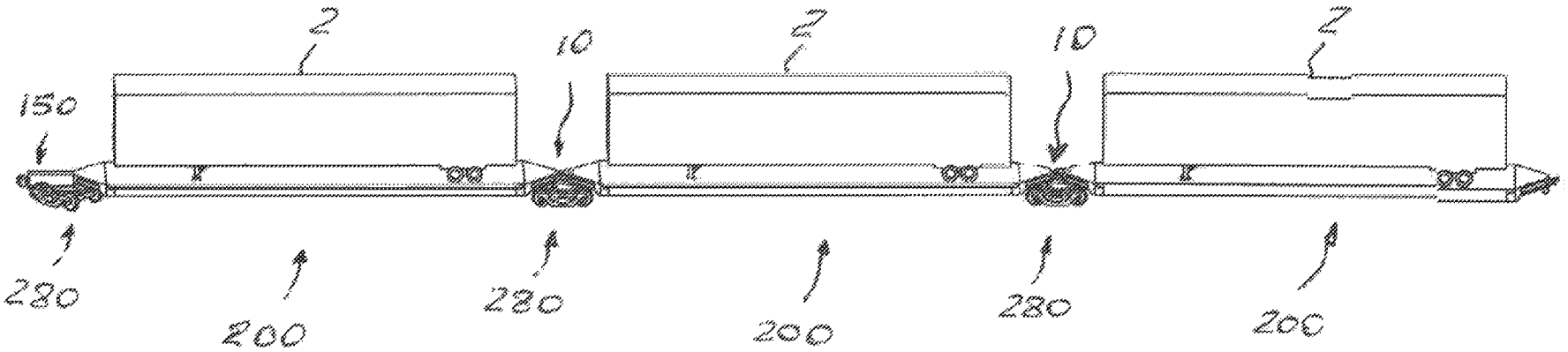
FIG. 6 illustrates an illustrates an environmental 3D view of the articulated rail coupler of FIGS. 1-5 employed to couple opposite ends of a pair of adjacent railcars in a semi-permanent manner.
Figure 7:
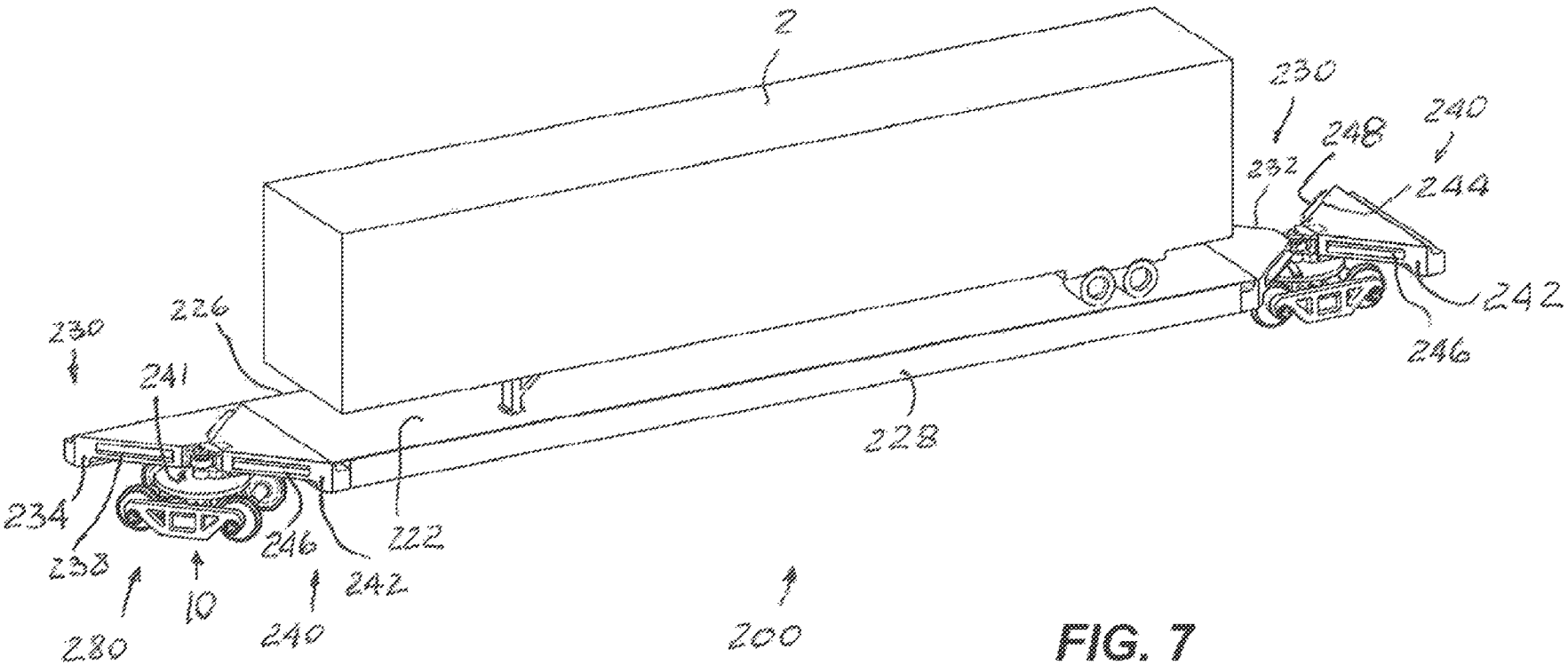
FIG. 7 illustrates a 3D view of a railcar employing the articulated couplers of FIGS. 1-6.
Figure 8:
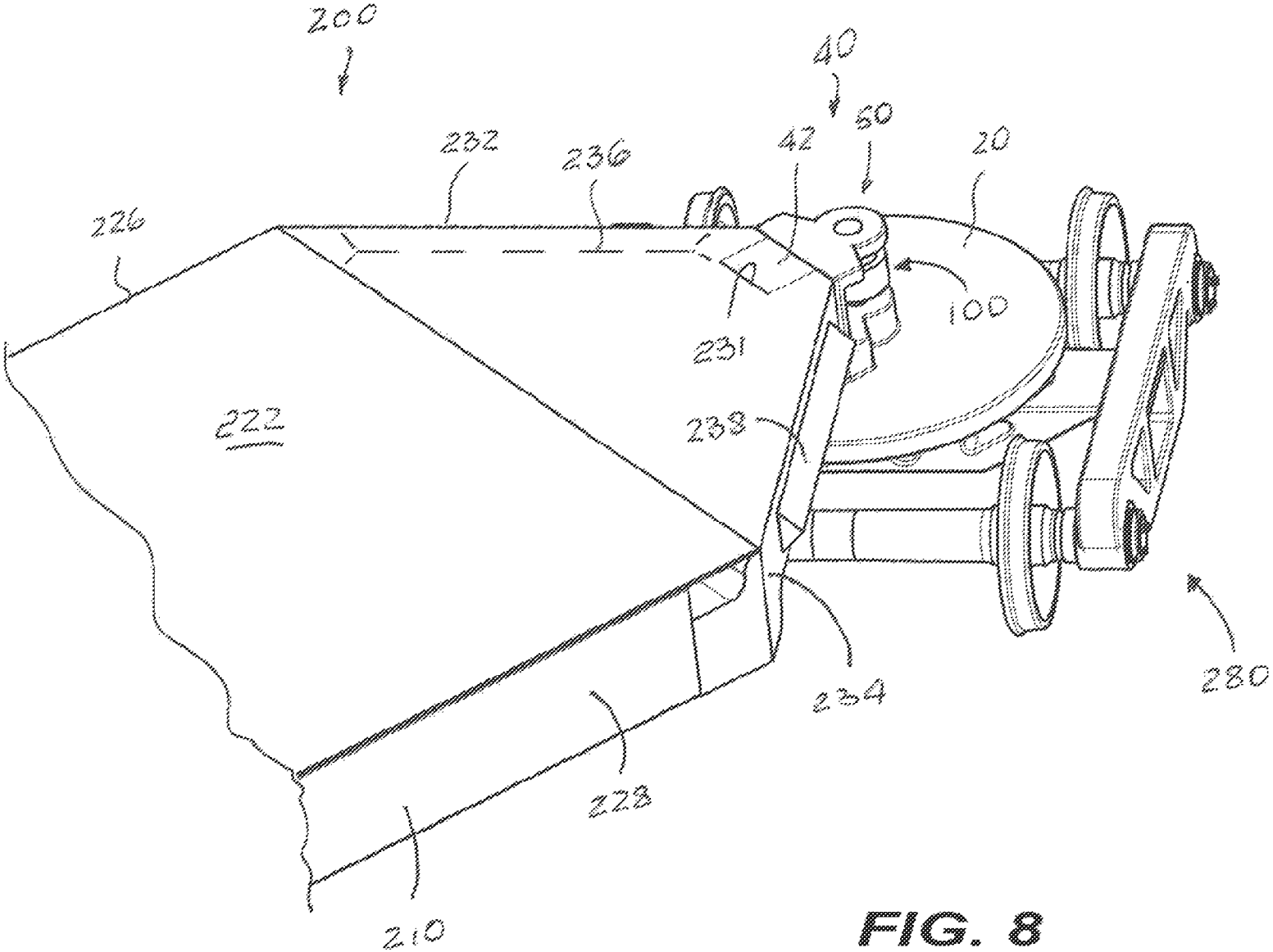
FIG. 8 illustrates an enlarged 3D view of one end of the railcar of FIG. 7.

Now in a reference to FIGS. 6-8, the articulated rail coupler 10 is being illustrated as coupling opposite ends of a pair of rail cars in a semi-permanent manner. FIG. 6 illustrates an example of three railcars 200 joined therebetween into a train consist with two articulated rail couplers 10, although more railcars 200 are also contemplated herewithin. More particularly, the articulated rail coupler 10 is employed in coupling opposite ends of a pair of railcars 200 in the semi-permanent manner where such opposite ends are supported on the single truck bogie 280.

In a further reference to FIG. 7, the railcar 200 is illustrated as a flatcar, for example of a type that is configured to transport one or more tractor trailers 2 on an upper surface 222 of the railcar frame 210. The upper surface 222 can be configured with an optional recess (not shown), as is conventional in the art. The railcar frame 210 further comprises a first end 230 and a second end 240 that is spaced apart from the first end 230 along a longitudinal axis 202 of the railcar 200. FIG. 8 illustrates an enlarged view of the first end 230 of the railcar 200 that is shown to the right in FIG. 8. The first end 230 is illustrated as comprising a first edge surface 232 that tapers inwardly from one side edge 226 and a second edge surface 234 that tapers inwardly from an opposite side edge 228 and toward the first edge surface 232. The first end 230 also comprises a notch 231 that is disposed centrally about the longitudinal axis 202. The notch 231 is sized and shaped to receive therewithin the first end 42 of the female connecting member 40. As it can be seen, for example in FIG. 8, the upper surface of the first end 42 is positioned essentially flush with the upper surface of the first end 230 after wielding. However, the notch 231 can be provided as a cavity and the cross-sectional size of the first end 42 will be reduced to accommodate such cavity 231. As is conventional, the first end 42 is generally welded to the end 230 of the railcar 200. The first end 230 can comprise an optional cavity 236 provided in the thickness of the first end 230 in an open communication with one of the first and second tapered edge surfaces, referenced with a numeral 232 and an optional abutment 238 provided on another one of the first and second tapered edge surfaces, referenced with a numeral 234. Each of the optional cavity 236 and the optional abutment 238 is being illustrated as single continuous elongated members, although each optional cavity can be provided as a plurality of cavities spaced apart from each other and the optional abutment 238 can be provided as a plurality of abutments. Furthermore, although each of the optional cavity 236 and the optional abutment 238 have been illustrated as comprising a triangular cross-sectional shape in a plane normal to a length of either the optional cavity 236 and the optional abutment 238, other cross-sectional shapes are also contemplated herewithin.

Figure 9:
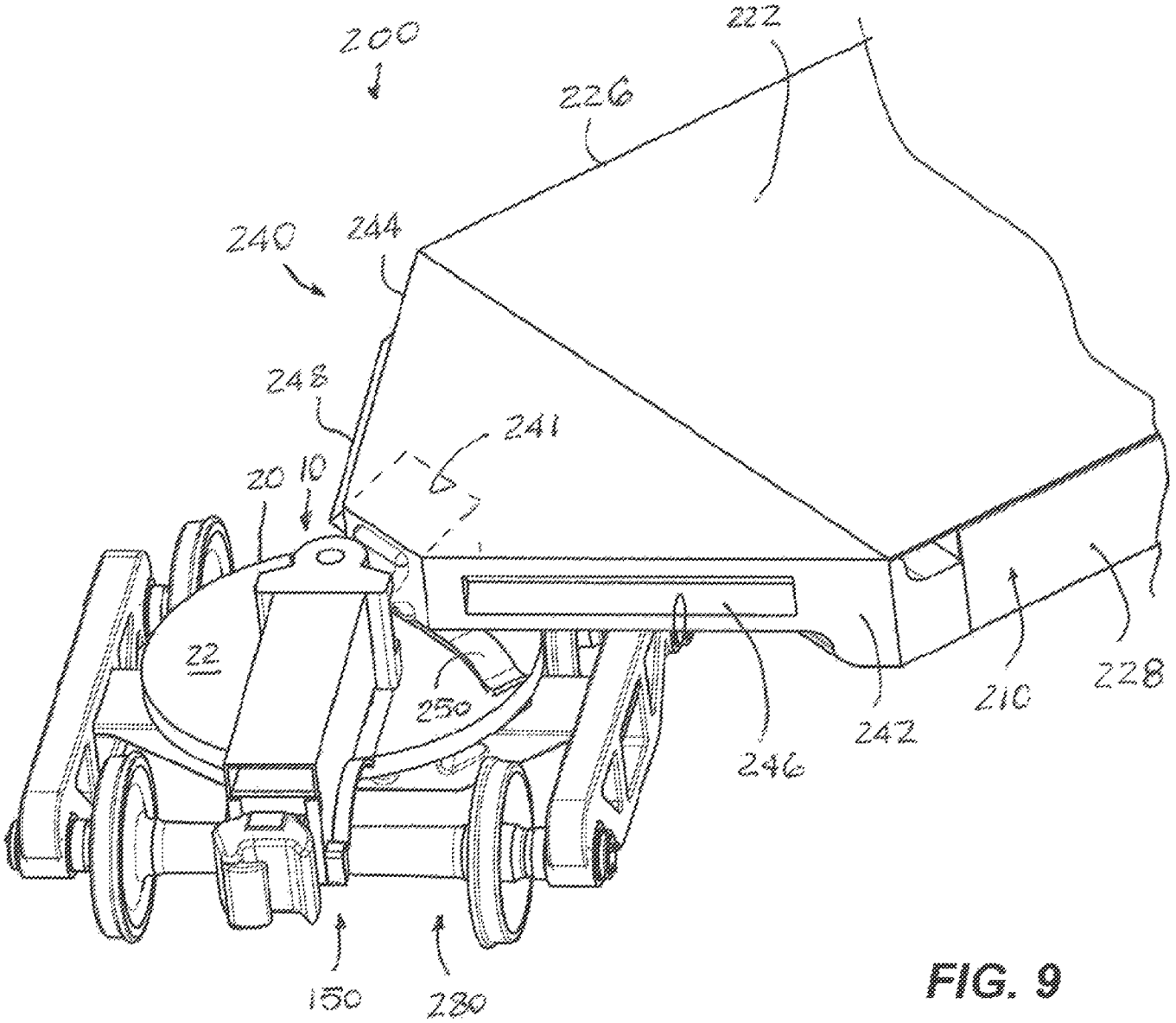
FIG. 9 illustrates an enlarged 3D view of another end the railcar of FIG. 7.

FIG. 9 illustrates an enlarged view of the second end 240 of the railcar 200 that is shown to the left in FIG. 9. The second end 240 is illustrated as comprising a first edge surface 242 that tapers inwardly from one side edge 228 and a second edge surface 244 that tapers inwardly from an opposite side edge 226 and toward the first edge surface 242. The second end 240 comprises a cavity 241 that is disposed centrally about the longitudinal axis 202. The cavity 241 is sized and shaped to receive therewithin the first end 92 of the male connecting member 90. In other words, when installed, the first end 92 is mostly hidden from direct view. However, the cavity 241 can be provided as a notch, for example as the above described notch 231, with the first end 92 being sized to larger to be received within such notch. As is conventional, the first end 92 is generally welded to the end 240 of the railcar 200. The first end 240 can also comprise an optional cavity 246 provided in the thickness of the second end 240 in an open communication with one of the first and second tapered edge surfaces, referenced with a numeral 242 and an optional abutment 248 provided on another one of the first and second tapered edge surfaces, referenced with a numeral 244. Each of the optional cavity 246 and the optional abutment 248 is being illustrated as single continuous elongated members, although the optional cavity 246 can be provided as a plurality of cavities spaced apart from each other and the optional abutment 248 can be provided as a plurality of abutments. Furthermore, although each of the optional cavity 246 and the optional abutment 248 have been illustrated as comprising a triangular cross-sectional shape in a plane normal to a length of either the optional cavity 246 and the optional abutment 248, other cross-sectional shapes are also contemplated herewithin.

As it will be explained further in this document, the optional cavities 236 and 246, when provided, are disposed diagonally opposite from each other across a truck bogie 280. Likewise, the optional abutments 238 and 248, when provided, are also disposed diagonally opposite from each other across the truck bogie 280. More particularly, when provided, the abutment 238 is sized and shaped to be received within the cavity 246 during operation of the railcar 200 and the abutment 248 is sized and shaped to be received within the cavity 236.

FIG. 7 illustrates one railcar 200 supported by the truck bogie 280 at each end. In other words, the railcar 200 is illustrated as being supported by a pair of truck bogies 280 during operation. For the sake of reader's convenience, the opposite second end 240 of one adjacent railcar 200 is shown to the left in FIG. 7, and the opposite first end 230 of another adjacent railcar 200 is shown to the right in FIG. 7. In other words, the railcar 200 in FIG. 7 can be the middle railcar 200 in FIG. 6. As is further illustrated, the first end 230 of the railcar 200 and the second end 240 of the adjacent railcar 200 are connected by one articulated coupler 10, while the second end 240 of the railcar 10 and a first end 230 of another adjacent railcar 200 are connected by another articulated rail coupler 10, each articulated rail coupler 10 being seated on a respective truck bogie 280. As it will be explained further, the first end 230 of the railcar 200 and the second end 240 of the adjacent railcar 200 are shown as being aligned along the longitudinal axis 202 as is particularly applicable during movement of the railcar 200 on a track 4, while the first end 230 of another adjacent railcar 200 is being shown as rotated forty-five degrees relative to the second end 240 of the railcar 10, as is can be applicable during loading/off-loading effort. FIG. 7 further illustrates, at the left side, how one end 230 can articulate or rotate relative to the opposite end 240. During this articulation or rotation, the optional abutment 248 engages the optional cavity 236 to support or stabilize both ends in a vertical direction during loading/off-loading effort. To provide additional support or stabilization in a vertical direction, the second end 240 is adapted with a leaf spring 250 that is attached to a bottom surface of the second end 240 and that contacts the upper surface 22 of the base member 20 during rotation of the second end 240 in a relationship to the opposite first end 230 of the adjacent railcar 200. However, the leaf spring 250 can be provided independently from the cavities 236, 246 and abutments 238, 248.

Thus, in an embodiment, the above described railcar 200 can further comprise a female connecting member 40 (including the base member 20 and the second bearing 140) with the first end 42 being received within the notch 231, or sized to be received within a cavity, and being directly coupled, by welding, to the first end 230 and a male connecting member 90 with the first end 92 being received within the cavity 241 and being directly coupled, by welding, to the second end 240. The railcars 200 in this embodiment, can be easily connected therebetween by installing the first bearing 130 after the female connecting member 40 on one end of the railcar 200 and the male connecting member 90 on the opposite end of the adjacent rail railcar 200 are aligned so that the second end 100 of the male connecting member 90 is positioned within the second end 50 of the female connecting member 40 and the apertures 70, 110 and the bore 74 are aligned with each other along the second axis 14.

Figure 10:
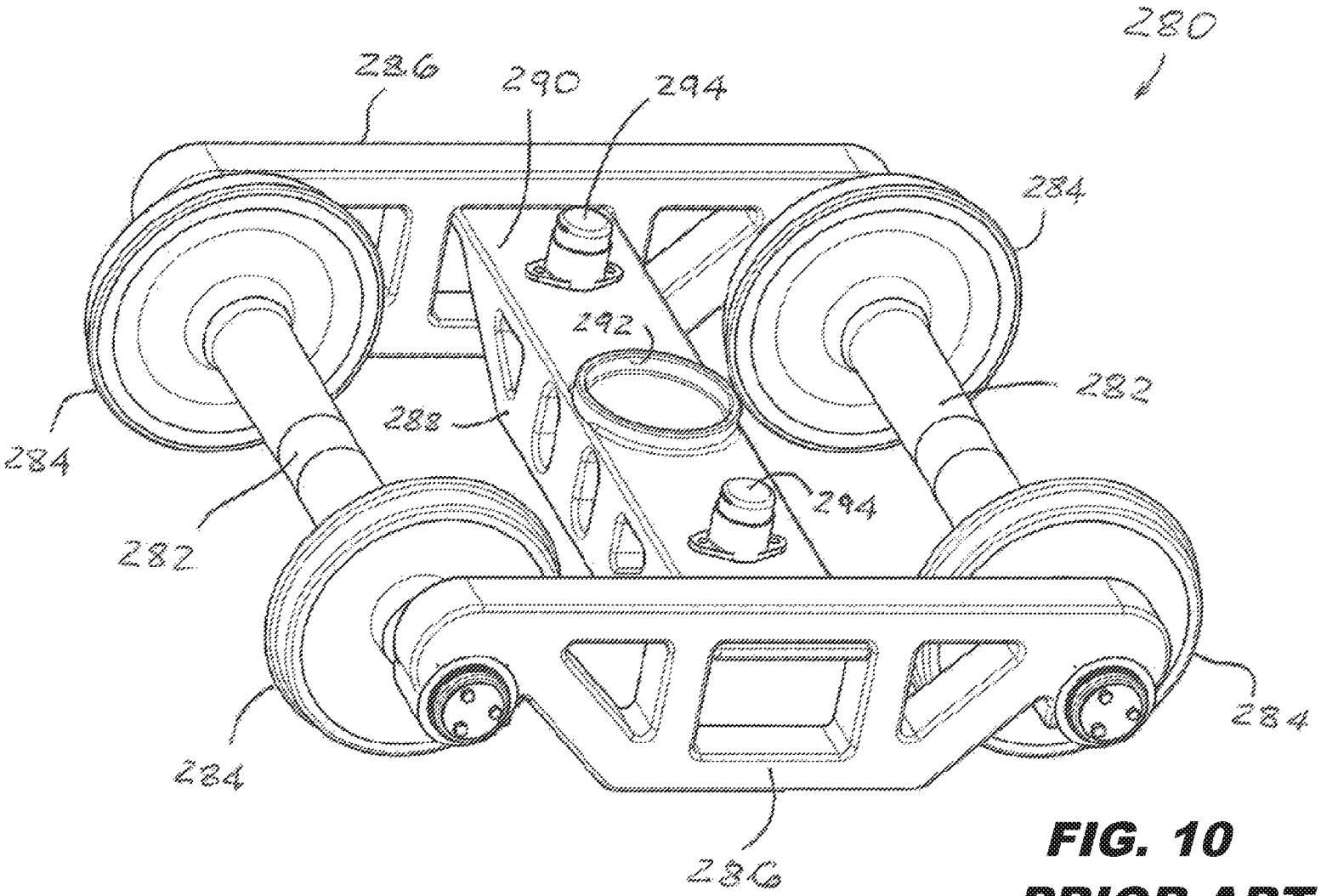
FIG. 10 PRIOR ART
FIG. 10 illustrates a 3D view of a truck bogie employable with the railcar of FIGS. 7-9.

Now in a particular reference to FIG. 10, labeled prior art, therein is shown a detail construction of a conventional truck bogie 280, for the sake of user's convenience. The truck bogie 280 comprises a pair of axles 282 spaced apart from each other along the longitudinal axis 202, a pair of wheels 284 on each axle 282, a pair of side frames 286, each of the pair of side frames 286 supported on one end of each axle 282, a bolster 288 extending between the pair of side frames 286, the bolster 288 having each end thereof affixed to a respective side frame 286, the bearing bowl 292 being disposed centrally on an upper surface 290 of the bolster 288, and a pair of side bearings 294 disposed on the surface of the bolster 286, each side bearing 294 being disposed adjacent a respective side frame 284. In the embodiment of FIGS. 6-8, each truck bogie 280 is disposed in an operative alignment with a respective articulated rail coupler 10.

Thus, in an embodiment, a railcar 200 can comprise a railcar frame 210. The railcar frame 210 comprises a body with a first end 230 and a longitudinally opposite second end 240, a first tapered edge surface 232, 242 in each of the first and second ends, 230 and 240 respectively, a second tapered edge surface 234, 244 in the each of the first and second ends, 230 and 240 respectively, a cavity 236, 246 in one of the first and second tapered edge surfaces, and an abutment 238, 248 on an another one of the first and second tapered edge surfaces 234, 244, the abutment 238, 248 being sized and shaped to be received within the respective cavity 236, 246 during operation of the railcar 200, a first articulated rail coupler 10, 150 coupled to one of the first and second ends; a second articulated rail coupler 10, 150 coupled to another one of the first and second ends, a first truck bogie 280 in an operative engagement with the first articulated rail coupler and a second truck bogie 280 in an operative engagement with the second articulated rail coupler.

Figure 11:
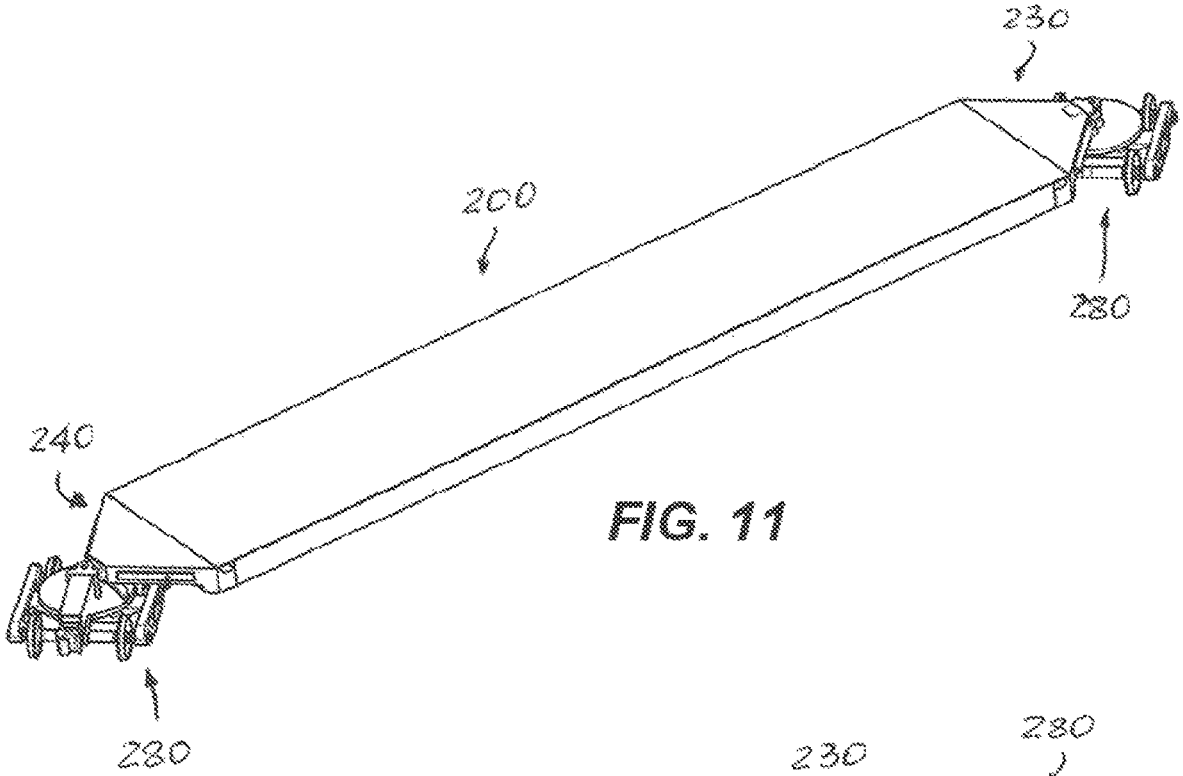
FIG. 11 illustrates one exemplary 3D view of a railcar employing the articulated coupler of FIGS. 1-6.
Figure 12:
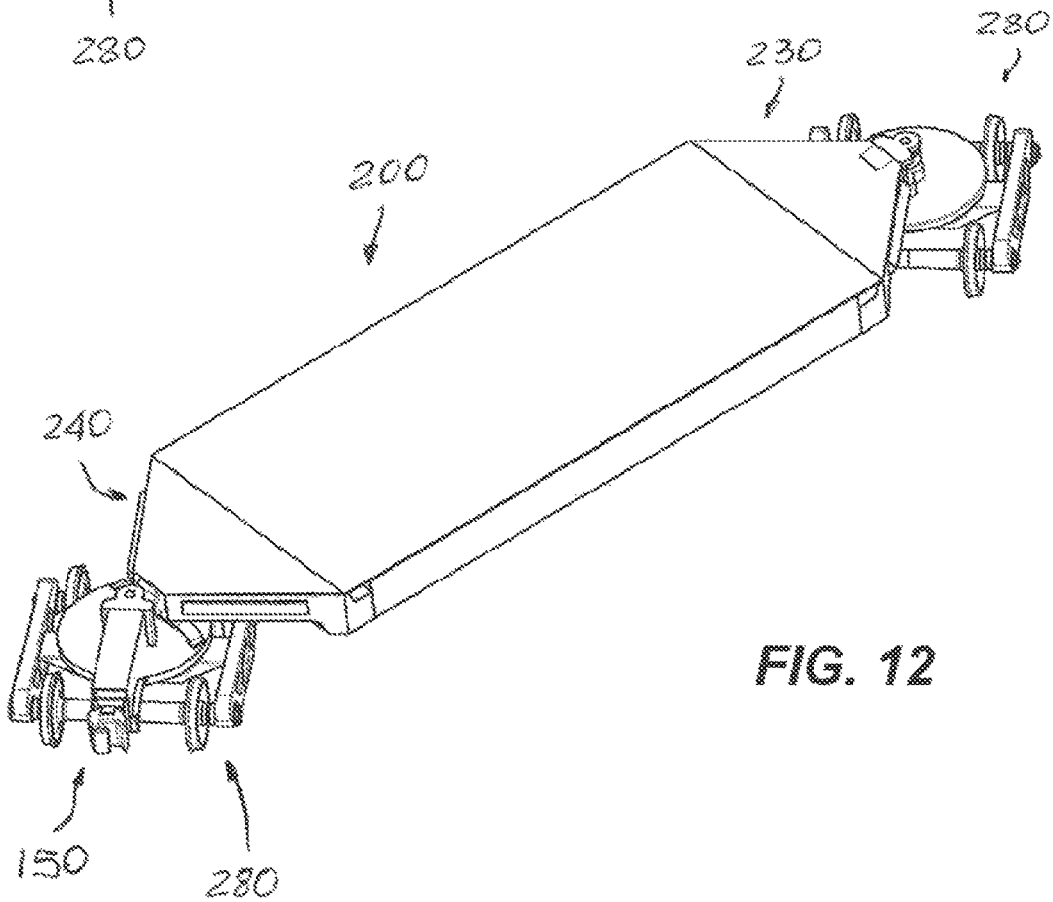
FIG. 12 illustrates one exemplary 3D view of a railcar employing the articulated coupler of FIGS. 1-6.

FIGS. 11 and 12 illustrate that a length of the railcar 200 can very. In an example of FIG. 11, the length of the railcar 200 can accommodate a pair of truck trailers 2. In an example of FIG. 11, the length of the railcar 200 can accommodate a single truck trailer 2. It would be understood that other objects or loads can be transported on railcars 200.

Now in a further reference to FIGS. 6, 9, and 11-13, therein is also illustrated an articulated rail coupler 150 that would be generally employed at a free end of the first or last railcar 200 in a train consist of railcars 200. The articulated rail coupler 150 allows ease of detachable coupling between the railcar 200 and a locomotive (not shown) or even detachable coupling between a pair of railcars. In an example, the railcar 200 comprising the articulated rail coupler 150 can be easily coupled to any other railcar that comprises a complimentary knuckle-type coupler on one or both ends so that the train consist can comprised railcars of mixed construction types. The exemplary articulated coupler 150 comprises a housing 160 with a wedge 180, a shock absorbing member, such as a draft gear 194, a coupler knuckle 192 and a coupler shank 190 being rigidly coupled to the coupler knuckle 192 and being detachably coupled to the draft gear 194.

Figure 13:
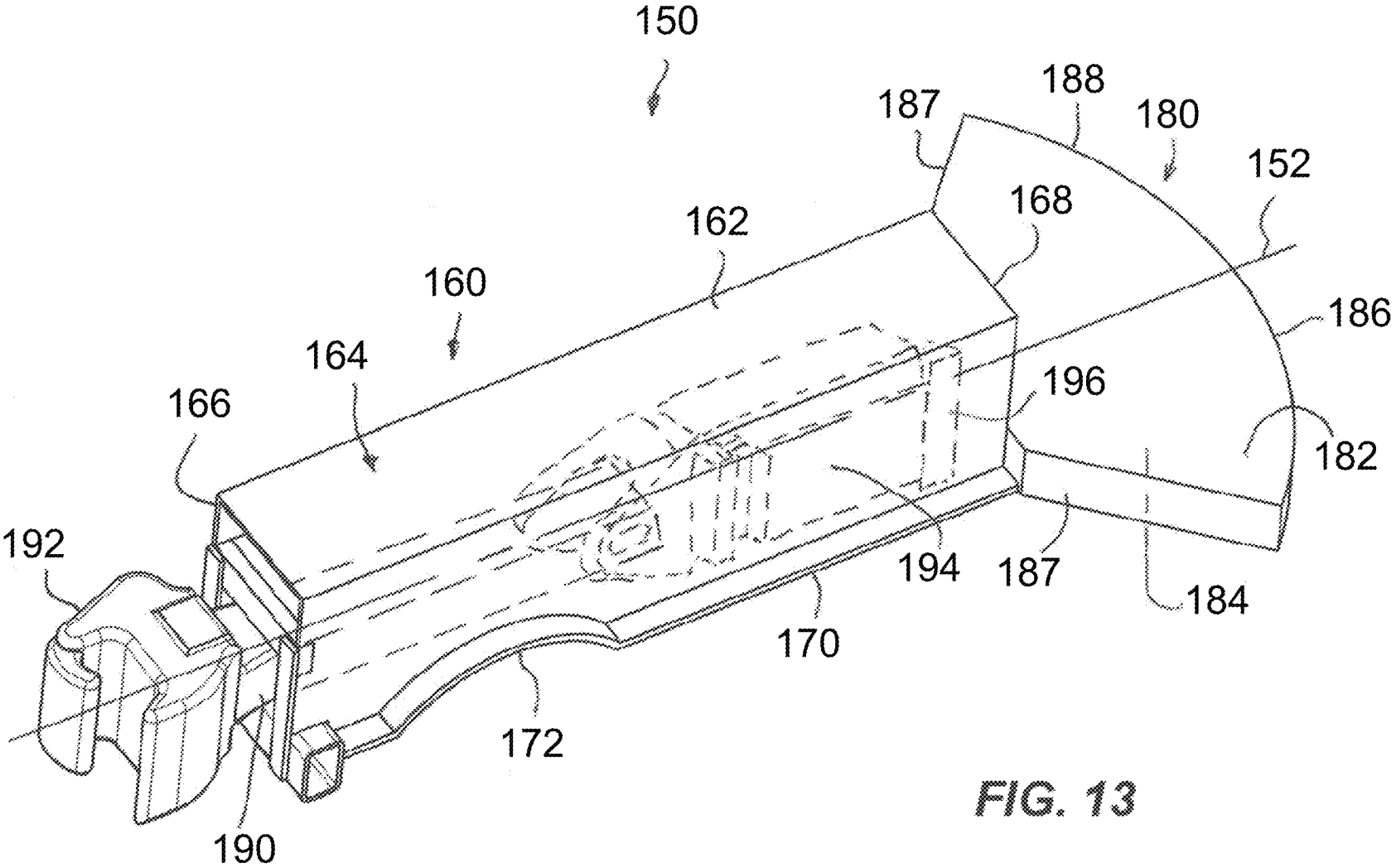
FIG. 13 illustrates a 3D view of an exemplary articulated rail coupler.

As is best illustrated in FIG. 13, the articulated coupler 150 comprises a housing 160. The housing 160 comprises a peripheral wall 162 defining a tubular shape with a hollow interior 164, a first open end 166 and a second open end 168 that is spaced apart from the first open end 156 along a longitudinal axis 152 of the articulated coupler 150. The first open end 166 is configured to receive therethrough a coupler shank. The second open end 168 is configured to receive therethrough either a first end 42 of the female connecting member 40 or the first end 92 of the male connecting member 90 (which are omitted in FIG. 13). The second end 168 is being further sized so as to allow direct and rigid coupling of such first end 42 or such first end 92 by welding. There is also a pair of flanges 170 (only one of which is shown in FIG. 13) on an exterior surface of the peripheral wall 162 at a bottom portion thereof, and a concave portion 172 disposed in the bottom portion of the peripheral wall 162, the concave portion 172 being sized and shaped to clear, during the operation of the articulated rail coupler 150, the axle 282 of the truck bogie 280. The housing 160 further comprises a wedge-shaped member 180 being rigidly coupled to the second end 168 of the housing 160 and extending outwardly therefrom in a generally horizontal plane during the operation of the articulated rail coupler 10. The wedge shaped member 180 comprising an upper surface 182, a lower surface 184 disposed at a distance from the upper surface 182 to define a thickness of the wedge-shaped member 180 and a peripheral edge surface 186 of the wedge-shaped member 180. The peripheral edge surface 186 comprising a pair of planar surface portions 187 and a curved surface portion 188 joining free ends of the pair of planar surface portions 187.

The articulated rail coupler 150 further comprises a coupler knuckle 192 disposed external to the first open end 166 of the housing 160, a shock absorbing device or a draft gear 194 being operatively mounted within the hollow interior 164 adjacent the second open end 168 of the housing 160 to absorbs buff and draft shocks during coupling of the articulated rail coupler 150 as well as shocks encountered by the articulated rail coupler 150 during operation, and a coupler shank 190 having one end thereof being rigidly coupled to the coupler knuckle 192 and having an opposite end thereof being detachably coupled to the draft gear 196. Any conventional draft gear can be used in the articulated rail coupler 150. Any conventional coupler knuckle with shank can be used in the articulated coupler 150. Conventional stop(s) 196 can be also used or the first end 42 or the first end 92 can be configured to act as stop(s) for the draft gear 194.

Thus in an embodiment, the articulated rail coupler, comprises the above described articulated coupler 10 and at least the above described housing 160 that can be rigidly joined or coupled, for example by a conventional welding process, although a friction fit and fastening method are also contemplated herewithin. The draft gear 194 and the coupler knuckle 192 with the coupler shank 190 can be mounted, in a conventional manner, after the first end 92 of the male connecting member 90 of the articulated coupler 10 is welded to the housing 160.

In an embodiment, the articulated rail coupler can comprise the above described housing 160 and either the female connecting member 40 with the base member 20 or the male connecting member 90 being rigidly coupled to the second open end 168.

In an embodiment, a first articulated rail coupler assembly on one end of the railcar 200 comprises the above described articulated rail coupler 10 and articulated rail coupler 150 in a rigid connection or coupling therebetween, a connection between the female connecting member 40 and the end of the railcar frame 210, and a leaf spring 250. Such rigid connection or coupling can comprise the first end 40 of the articulated rail coupler 10 received, through the open second end 168, within the hollow interior 164. The first end 40 is then welded to the second open end 168, although a friction fit and fastening are also contemplated herewithin. In this rigid connection or coupling, the wedge shaped member 180 is fitted within a space 32 between an exterior surface of the first end 42 and a top surface 22 of the plate shaped member 20. The fit can be a loose fit or a friction fit. In this embodiment, a second coupler assembly on an opposite end of the railcar 200 can comprise any one of the articulated coupler 10, a female connecting member 40 thereof and the male connecting member 60.

In an embodiment, each of the first and second articulated rail coupler assemblies can comprise any one of the articulated coupler 10, a female connecting member 40 thereof and the male connecting member 90.

In an embodiment, an articulated coupler assembly comprises a first coupler, such as the above described articulated coupler 10 on one end of the railcar 200 and a second coupler, such as the above described articulated coupler 150 on an opposite end of the railcar 200.

Figure 14:
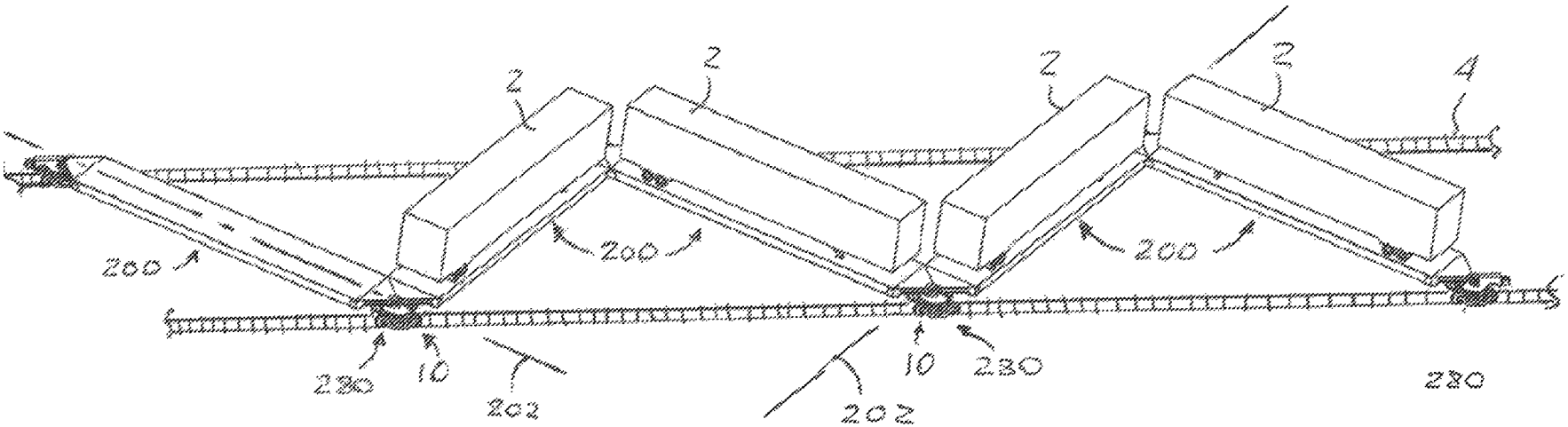
FIG. 14 illustrates a 3D view of arranging railcars of FIGS. 7-9 on a pair of spaced apart parallel rail tracks.

FIG. 14 illustrates an articulated arrangement of railcars 200 on a pair of rail tracks 4 so as to enable loading/off-loading effort of each railcar 200 from a respective end. In this configuration, the first end 230 and the second end 240 are pivoted or rotated about each other so that the longitudinal axis 202 of each railcar 200 is aligned at about forty-five (45) degrees to an edge of a platform (not shown), enabling railcar end loading/off-loading. Furthermore, in this arrangement, the edges of the first and second ends, for example such as 232 and 244 or 234 and 242 are aligned parallel to the edge of the platform (not shown), so that a material handling vehicle, for example such as a fork lift truck (not shown), travels on both ends 230, 240 of two adjacent railcars 200 during loading/off-loading through either end. In other words, a pair of edges on opposite ends of a pair of adjacent railcars 200 define a single edge. At the terminal ends of the train consist, an optional moveable member can be attached to the platform edge, mounted for a movement on a railcar frame 210 or loading/off-loading can only be performed from an opposite end of the respective railcar 200.

The opposite ends of the adjacent railcars 200 can be than supported in a vertical direction during loading/off-loading effort by any one of interlocking cavities and abutments, overlapping base member 20 with the wedge shaped member 180 and the leaf spring 250.

Thus, a method of railcar end loading/off-loading comprises adapting each railcar 200 with the tapered end 230, 240; coupling each end of the railcar 200 with the above described articulated couplers 10 and/or 150; articulating each railcar 200 on a pair of spaced apart parallel rail tracks 4 to position a longitudinal axis 202 of each railcar 200 at an angle of about forty-five (45) degrees to an edge of a platform; and loading or off-loading each railcar 200 from one or both, ends thereof. The method provides for positioning railcars 200 without decoupling one railcar 200 from another.

Figure 15:
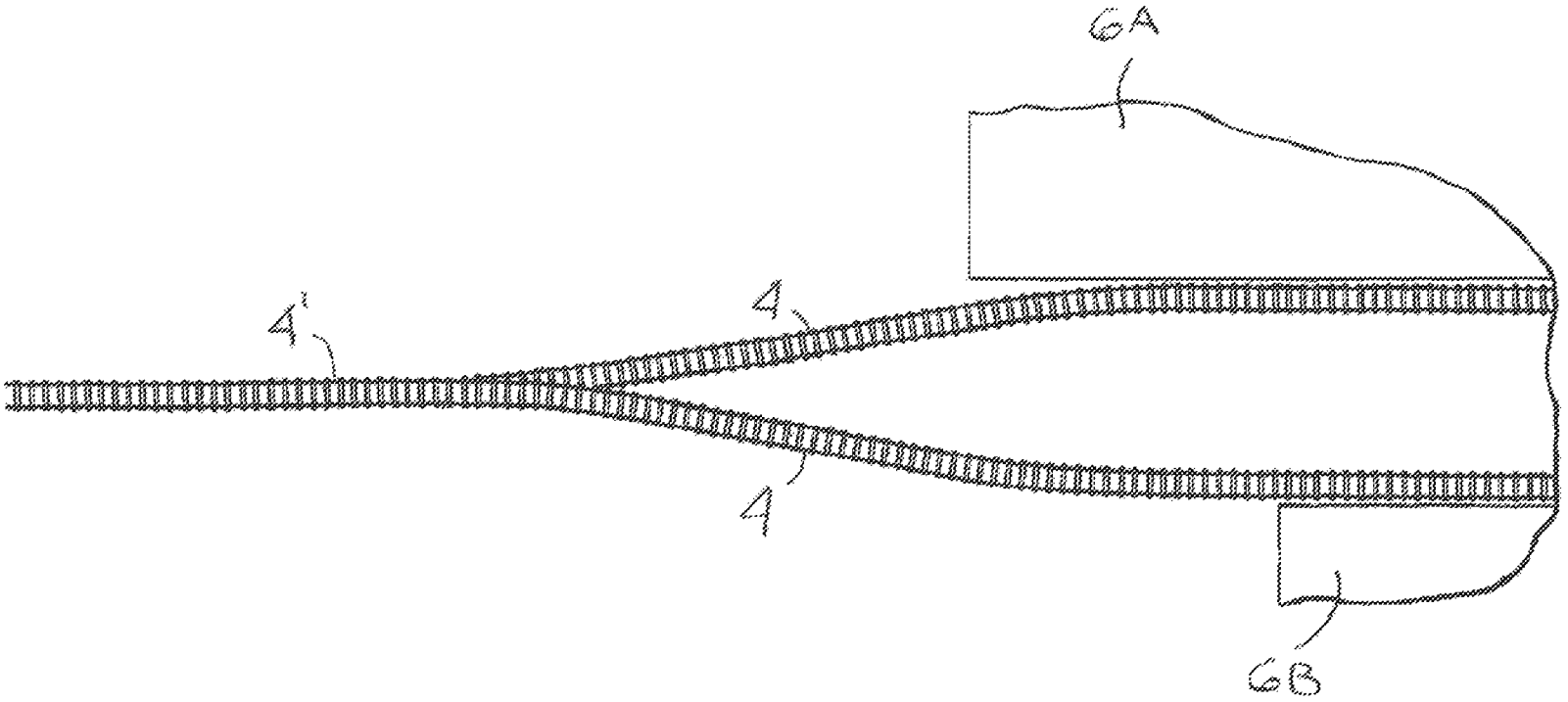
FIG. 15 illustrates a plan view of a single switch and lead in track for a terminal with a single spur.

FIG. 15 illustrates a schematic diagram of an exemplary rail terminal that comprises a pair of docks or platforms 6A, 6B and a pair of tracks 4 extending from a single rail track spur 4' that can be adapted with a rail switch (not shown) at a split between the single rail track spur 4' and the pair of tracks 4. The rail switch (not shown) has a common connection attached to each track portion 4. It has a selectable track connection also connected to each track portion 4, and a second selectable track connection to which the spur 4' is attached. A portion of each track portion 4 lies adjacent and parallel to edge of dock or platform 6A and/or 6B. The track portions 4 are spaced relative to dock edges so that railcar 200 generally, including locomotives may be moved along each track portion 4 without contacting dock edge. This is preferred for operational flexibility. The track portions 4 are so positioned relative to the dock edge that side edge of the ends 230 and 240 are disposed at a clearance from the dock edge. This clearance should be small enough that highway vehicles 2 can drive across it.

Thus, in an embodiment, the subject matter also provides a rail terminal wherein the railcars 200 are positioned at an angle of about forty-five (45) degrees relative to one or two platform edges of the terminal. Such positioning of the railcars 200 adapted with tapered ends 230, 240 and coupled therebetween with articulated rail couplers 10 (and 150) solves the problem(s) of loading the tractor trailers onto the railcars and off-loading tractor trailers from the rail cars.

The chosen exemplary embodiments of the claimed subject matter have been described and illustrated, to plan and/or cross section illustrations that are schematic illustrations of idealized embodiments, for practical purposes so as to enable any person skilled in the art to which it pertains to make and use the same. As such, variations from the shapes of the illustrations as a result, for example, of manufacturing techniques and/or tolerances, are to be expected. It is therefore intended that all matters in the foregoing description and shown in the accompanying drawings be interpreted as illustrative and not in a limiting sense. For example, a region illustrated or described as flat may, typically, rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims. It will be understood that variations, modifications, equivalents and substitutions for components of the specifically described exemplary embodiments of the invention may be made by those skilled in the art without departing from the spirit and scope of the invention as set forth in the appended claims.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceding specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible.

Any numerical value, however, inherently contains certain errors necessarily resulting from the standard deviations found in their respective testing measurements.

Anywhere the term "comprising" is used, embodiments and components "consisting essentially of" and "consisting of" are expressly disclosed and described herein."

Furthermore, the Abstract is not intended to be limiting as to the scope of the claimed invention and is for the purpose of quickly determining the nature of the claimed invention.

What is claimed is:

1. An articulated rail coupler, comprising a base member, a female connecting member upstanding on said base member, a male connecting member, a void through a thickness of said base member, an aperture in said male connecting member, a first bearing seated within said aperture and within said female connecting member, said first bearing defining a vertical axis of rotation, and a second bearing configured and sized to be received within a truck bogie bearing bowl, said male connecting member rotatable relative to said female connecting member about said vertical axis of rotation in a range of about ninety degrees.

2. The articulated rail coupler of claim 1, wherein said base member comprises:

an upper surface;

a lower surface, said lower surface being spaced apart from said upper surface to define a thickness and a peripheral edge surface of said base member; and wherein said void through said thickness of said base member is in an open communication with said peripheral edge surface.

3. The articulated rail coupler of claim 1, wherein said female connecting member comprises:

a first end positioned at a distance from an upper surface of said base member, said first end comprising a cavity and a generally rectangular or a generally square cross-section in a plane normal to said upper surface, said cavity being in an open communication with a free peripheral edge of said first end, said first end defining a first axis of said articulated rail coupler, said first axis being disposed generally horizontally during operation of said articulated rail coupler; and a second end comprising:

a first wall with an inner surface and a pair of first edge surfaces, each of said pair of first edge surfaces disposed generally normal to said upper surface and tapering inwardly from a respective side edge surface of said first wall, a second wall upstanding on said upper surface of said base member, said second wall comprising an inner surface disposed generally parallel to and at a distance from said inner surface of said first wall and a pair of second edge surfaces, each of said pair of second edge surfaces disposed generally normal to said upper surface and tapering inwardly from a respective side edge surface of said second wall, said each of said pair of second edge surfaces is coplanar with a respective one of said pair of first edge surfaces, an aperture formed through a thickness of said first wall and define a second axis of said articulated rail coupler, said second axis being disposed generally vertically during said operation of said articulated rail coupler, a bore formed in said second wall in a vertical axial alignment with said aperture, a third wall connecting said first wall and said second wall, said third wall being in an abutting relationship with said first end and having an inner surface, and a cavity in said inner surface of said third wall.

4. The articulated rail coupler of claim 1, wherein said male connecting member comprises:

a first end comprising a cavity and a generally rectangular or a generally square cross-section in a plane normal to upper and lower surfaces of said base member, said cavity of said male connecting member being in an open communication with a free peripheral edge of said first end of said male connecting member, and a second end comprising:

a first surface, a second surface being spaced apart from said first surface, a thickness of said second end of said male connecting member defined by a distance between said first surface and said second surface, said thickness of said second end of said male connecting member being smaller than a height of said first end, and said aperture being through said thickness of said second end of said male connecting member, said aperture of said male connecting member being axially aligned with an aperture through a first wall of a second end of said female connecting member and with a bore in said second end of said female connecting member.

5. The articulated rail coupler of claim 1, wherein said first bearing comprises:

a main portion comprising a partially spherical exterior surface being sized to be received within said aperture, said main portion being further sized to pass through said aperture in a second end of said female connecting member;

a first end extending from said main portion, said first end sized to be seated within said aperture in said second end of said female connecting member; and a second end extending from said main portion axially opposite to said first end of said first bearing along a second axis, said second end of said first bearing being sized to be seated within a blind bore in said second end of said female connecting member.

6. The articulated rail coupler of claim 1, wherein a second end of said male connecting member movable in an articulated manner about said first bearing so that said male connecting member movable in said articulated manner about said female connecting member.

7. The articulated rail coupler of claim 1, further comprising:

a housing comprising a peripheral wall defining a tubular shape with a hollow interior, an open first end and an axially opposite second end, a pair of flanges on an exterior surface of said peripheral wall at a bottom portion thereof, and a concave portion disposed in said bottom portion of said peripheral wall, said concave portion being sized and shaped to clear an axle of a truck bogie of a railcar;

a wedge-shaped member being rigidly coupled to said second end of said housing and extending outwardly therefrom, said wedge-shaped member comprising an upper surface, a lower surface disposed at a distance from said upper surface to define a thickness of said wedge-shaped member and a peripheral edge surface of said wedge-shaped member, said peripheral edge surface comprising a pair of planar surface portions and a curved surface portion joining free ends of said pair of planar surface portions;

a draft gear operatively mounted within said hollow interior adjacent said second end of said housing;

a coupler knuckle extending outwardly from said first end of said housing; and a coupler shank having one end thereof being rigidly coupled to said coupler knuckle and having an opposite end thereof being detachably coupled to said draft gear.

8. The articulated rail coupler of claim 1, wherein:

said base member is a disk-shaped base member, comprising:

an upper surface, a lower surface, said lower surface being spaced apart from said upper surface to define said thickness and a peripheral edge surface of said disk-shaped base member, and wherein said void through said thickness being in an open communication with said peripheral edge surface; and wherein said female connecting member comprising a box-shaped first end positioned over said void and at a distance from said upper surface, and a U-shaped second end, said U-shaped second end upstanding on said upper surface of said disk-shaped base member, an aperture in one wall of said U-shaped second end, and a bore in another wall of said U-shaped second end in a substantially vertical alignment with said aperture.

9. The articulated rail coupler of claim 1, wherein said female connecting member comprises a first end thereof being positioned at a distance from an upper surface of said base member, and a U-shaped second end upstanding on said upper surface of said base member and being axially aligned with said first end along an axis, said axis being disposed generally horizontal during operation of said articulated rail coupler.

10. The articulated rail coupler of claim 9, wherein said first bearing is secured within said U-shaped second end.

11. The articulated rail coupler of claim 1, wherein said male connecting member comprises a first end positioned at a distance from an upper surface of said base member, and a second end, said second end configured to articulate about a portion of said first bearing within a U-shaped second end and rotate in a generally horizontal plane about said vertical axis of rotation.

12. The articulated rail coupler of claim 1, wherein said female connecting member comprises a first end positioned at a first distance from an upper surface of said base member, and a U-shaped second end upstanding on said upper surface of said base member and being axially aligned with said first end along an axis, said axis being disposed generally horizontal during operation of said articulated rail coupler;

said first bearing being secured in said U-shaped second end; and said male connecting member comprises a first end thereof being positioned at a second distance from said upper surface of said base member, and a second end, said second end of said male connecting member configured to articulate about a portion of said first bearing within said U-shaped second end and rotate in a generally horizontal plane about said vertical axis of rotation.

13. The articulated rail coupler of claim 1, wherein any one of said base member, said female connecting member and said male connecting member comprises a casting.

14. The articulated rail coupler of claim 1, further comprising a bearing race disposed in said aperture of said male connecting member, said first bearing being seated within said bearing race.

15. The articulated rail coupler of claim 14, wherein said bearing race comprises any one of a bronze material, a nylon material, and a teflon material.

16. The articulated rail coupler of claim 1, wherein said aperture comprises a partially spherical inner surface.

17. An articulated rail coupler that couples opposite ends of a pair of adjacent railcars in a semi-permanent manner, said articulated rail coupler comprising:

a disk-shaped base member comprising:

an upper surface, a lower surface, said lower surface being spaced apart from said upper surface to define a thickness and a peripheral edge surface of said disk-shaped base member, and a void through said thickness in an open communication with said peripheral edge surface;

a female connecting member comprising:

a first end positioned over said void and at a distance from said upper surface, said first end comprising a cavity and a generally rectangular or a generally square cross-section in a plane normal to said upper and lower surfaces, said cavity being in an open communication with a free peripheral edge of said first end, said first end defining a first axis of said articulated rail coupler, and a second end comprising:

a first wall with an inner surface and a pair of first edge surfaces, each of said pair of first edge surfaces disposed generally normal to said upper surface and tapering inwardly from a respective side edge surface of said first wall, a second wall upstanding on said upper surface of said disk-shaped base member, said second wall comprising an inner surface disposed generally parallel to and at a distance from said inner surface of said first wall and a pair of second edge surfaces, each of said pair of second edge surfaces disposed generally normal to said upper surface and tapering inwardly from a respective side edge surface of said second wall, said each of said pair of second edge surfaces is coplanar with a respective one of said pair of first edge surfaces, an aperture formed through a thickness of said first wall and defining a second axis of said articulated rail coupler, a bore formed in said second wall in a vertical axial alignment with said aperture, a third wall connecting said first wall and said second wall, said third wall being in an abutting relationship with said first end and having an inner surface, and a cavity in said inner surface of said third wall;

a male connecting member comprising:

a first end comprising a cavity and a generally rectangular or a generally square cross-section in said plane normal to said upper and lower surfaces, said cavity of said male connecting member being in an open communication with a free edge of said first end of said male connecting member, and a second end comprising:

a first surface, a second surface being spaced apart from said first surface, a thickness of said second end of said male connecting member defined by a distance between said first surface and said second surface, said thickness of said second end of said male connecting member being smaller than said distance between said inner surface of said first wall and said inner surface of said second wall of said second end of said female connecting member, an aperture through said thickness of said second end of said male connecting member, said aperture of said male connecting member being axially aligned with said aperture through said first wall of said second end of said female connecting member and with said bore, said first end of said male connecting member is being generally aligned with said first end of said female connecting member along said first axis;

a bearing race disposed in said aperture of said second end of said male connecting member, said bearing race comprising and outer surface sized and shaped to contact an inner surface of said aperture through said thickness of said second end of said male connecting member so as to prevent a movement of said bearing race relative to said aperture through said thickness of said second end of said male connecting member, said bearing race further comprising an inner surface with a partially spherical shape;

a first bearing comprising:

a main portion comprising a partially spherical exterior surface being sized to be received within said inner surface of said bearing race, said main portion being further sized to pass through said aperture in said second end of said female connecting member, a first end extending from said main portion, said first end sized to be seated within said aperture in said second end of said female connecting member, and a second end extending from said main portion axially opposite to said first end of said first bearing along said second axis, said second end sized to be seated within said bore in said second end of said female connecting member, said second end of said male connecting member movable in an articulated manner about said main portion of said first bearing so that said male connecting member moves in said articulated manner about said female connecting member, said male connecting member pivotable in a range of about ninety degree about said second axis, said first and second surfaces of said second end of said female connecting member positioned to limit a pivoting of said male connecting member about said second axis; and a second bearing upstanding on said lower surface of said disk-shaped base member, said second bearing being sized and shaped to be received within a truck bogie bearing bowl.

18. An articulated rail coupler, comprising:

a female connecting member comprising:

a disk-shaped member;

a first end with a cavity, and a second end comprising:

a first wall, a second wall, disposed parallel to said first wall and in an abutting relationship or integral with a surface of said disk-shaped member, an aperture formed through said first wall, a bore formed in said second wall in an axial vertical alignment with said aperture, and a third wall connecting said first wall and said second wall, said third wall being in an abutting relationship with said first end, a male connecting member comprising:

a first end with a cavity, and a second end with an aperture, said aperture of said second end of said male connecting member is being axially alignable with said aperture through said first wall of said second end of said female connecting member and said bore;

a bearing race disposed in said aperture of said second end of said male connecting member, said bearing race having an inner surface with a partial spherical shape;

a bearing configured to connect said second end of said female connecting member with said second end of said male connecting member, said bearing comprising:

a main portion comprising a partially spherical exterior surface, a first end extending from said main portion, said first end sized to be seated within said aperture in said second end of said female connecting member, and a second end extending from said main portion axially opposite to said first end of said bearing, said second end of said bearing being sized to be seated within said bore in said second end of said female connecting member; and a coupler bearing configured and sized to be received within a truck bogie bearing bowl.

* * * * *